US010731418B2

(12) United States Patent
Peters

(10) Patent No.: US 10,731,418 B2
(45) Date of Patent: Aug. 4, 2020

(54) ROTARY STEERABLE DRILLING ASSEMBLY WITH A ROTATING STEERING DEVICE FOR DRILLING DEVIATED WELLBORES

(71) Applicant: Volker Peters, Wienhausen (DE)

(72) Inventor: Volker Peters, Wienhausen (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 181 days.

(21) Appl. No.: 15/210,669

(22) Filed: Jul. 14, 2016

(65) Prior Publication Data

US 2018/0016844 A1 Jan. 18, 2018

(51) Int. Cl.

| | |
|---|---|
| ***E21B 7/06*** | (2006.01) |
| ***E21B 17/04*** | (2006.01) |
| ***E21B 17/10*** | (2006.01) |
| ***E21B 21/10*** | (2006.01) |
| ***E21B 44/00*** | (2006.01) |
| ***E21B 47/022*** | (2012.01) |
| ***E21B 47/06*** | (2012.01) |
| ***E21B 47/12*** | (2012.01) |
| *E21B 47/18* | (2012.01) |

(52) U.S. Cl.

CPC ..... *E21B 7/067* (2013.01); *E21B 7/06* (2013.01); *E21B 7/068* (2013.01); *E21B 17/04* (2013.01); *E21B 17/1078* (2013.01); *E21B 21/10* (2013.01); *E21B 44/00* (2013.01); *E21B 47/022* (2013.01); *E21B 47/06* (2013.01); *E21B 47/065* (2013.01); *E21B 47/12* (2013.01); *E21B 47/122* (2013.01); *E21B 47/18* (2013.01)

(58) Field of Classification Search

CPC ..... E21B 7/067; E21B 17/04

See application file for complete search history.

(56) References Cited

U.S. PATENT DOCUMENTS

| | | | | |
|---|---|---|---|---|
| 2,971,770 A | | 2/1961 | Wagner | |
| 3,743,034 A | * | 7/1973 | Bradley | E21B 7/06 175/61 |
| 3,941,197 A | * | 3/1976 | Stinson | E21B 10/38 175/400 |
| 4,703,814 A | * | 11/1987 | Nguyen | E21B 10/62 175/393 |

(Continued)

FOREIGN PATENT DOCUMENTS

| | | |
|---|---|---|
| WO | 2003052236 A1 | 6/2003 |
| WO | 2003052237 A1 | 6/2003 |

OTHER PUBLICATIONS

PCT International Search Report and Written Opinion; International Application No. PCT/US2017/041632; International Filing Date: Jul. 12, 2017; dated Sep. 22, 2017; pp. 1-13.

(Continued)

*Primary Examiner* — Shane Bomar

(74) *Attorney, Agent, or Firm* — Cantor Colburn LLP

(57) ABSTRACT

A drilling assembly for drilling deviated wellbores is disclosed that in one embodiment includes a steering unit having an upper section coupled to a lower section through a tilt device, wherein an electro-mechanical actuation device tilts the tilt device about a selected location in the drilling assembly to cause the lower section to tilt relative to the upper section along a selected direction while the drill string is rotating.

20 Claims, 5 Drawing Sheets

(56) References Cited

U.S. PATENT DOCUMENTS

| | | | | |
|---|---|---|---|---|
| 4,974,688 | A | 12/1990 | Helton | |
| 5,671,816 | A | 9/1997 | Tibbitts | |
| 6,092,610 | A | 7/2000 | Kosmala et al. | |
| 6,109,372 | A * | 8/2000 | Dorel | E21B 47/08 175/269 |
| 6,158,529 | A | 12/2000 | Dorel | |
| 6,837,315 | B2 | 1/2005 | Pisoni et al. | |
| 7,188,685 | B2 | 3/2007 | Downton et al. | |
| 7,360,609 | B1 | 4/2008 | Falgout, Sr. | |
| 7,762,356 | B2 | 7/2010 | Turner et al. | |
| 7,802,637 | B2 | 9/2010 | Aronstam et al. | |
| 8,469,117 | B2 | 6/2013 | Pafitis et al. | |
| 8,590,636 | B2 | 11/2013 | Menger | |
| 8,763,725 | B2 | 7/2014 | Downton | |
| 9,057,223 | B2 | 6/2015 | Perrin et al. | |
| 9,145,736 | B2 | 9/2015 | Peter et al. | |
| 9,828,804 | B2 | 11/2017 | Pearce et al. | |
| 2003/0127252 | A1 | 7/2003 | Downton et al. | |
| 2009/0008151 | A1 | 1/2009 | Turner et al. | |
| 2009/0032302 | A1* | 2/2009 | Downton | E21B 7/067 175/38 |
| 2009/0166089 | A1* | 7/2009 | Millet | E21B 7/067 175/61 |
| 2009/0272579 | A1 | 11/2009 | Sihler et al. | |
| 2010/0108380 | A1* | 5/2010 | Teodorescu | E21B 10/00 175/24 |
| 2011/0100716 | A1 | 5/2011 | Shepherd | |
| 2011/0284292 | A1 | 11/2011 | Gibb et al. | |
| 2012/0018225 | A1 | 1/2012 | Peter et al. | |
| 2013/0341095 | A1* | 12/2013 | Perrin | E21B 7/062 175/45 |
| 2013/0341098 | A1 | 12/2013 | Perrin et al. | |
| 2014/0110178 | A1 | 4/2014 | Savage et al. | |
| 2014/0209389 | A1 | 7/2014 | Sugiura et al. | |
| 2015/0114719 | A1 | 4/2015 | Pearce et al. | |
| 2016/0108679 | A1 | 4/2016 | Bayliss | |
| 2017/0044834 | A1 | 2/2017 | Peters | |
| 2018/0016845 | A1 | 1/2018 | Peters | |
| 2018/0016846 | A1 | 1/2018 | Peter et al. | |

OTHER PUBLICATIONS

PCT International Search Report and Written Opinion; International Application No. PCT/US2017/041634; International Filing Date: Jul. 12, 2017; dated Sep. 22, 2017; pp. 1-13.

PCT International Search Report and Written Opinion; International Application No. PCT/US2017/041635; International Filing Date: Jul. 12, 2017; dated Sep. 22, 2017; pp. 1-13.

* cited by examiner

ROTARY STEERABLE DRILLING ASSEMBLY WITH A ROTATING STEERING DEVICE FOR DRILLING DEVIATED WELLBORES

CROSS REFERENCES TO RELATED APPLICATIONS

The present application is related to U.S. patent application Ser. No. 15/210,707 and U.S. patent application Ser. No. 15/210,735, filed Jul. 14, 2016, the contents of which are hereby incorporated by reference herein in their entirety.

BACKGROUND

1. Field of the Disclosure

The disclosure relates generally to rotary drilling systems for drilling of deviated wellbores and particularly to a drilling assembly that utilizes a rotating steering device for drilling deviated wellbores.

2. Background Art

Wells or wellbores are formed for the production of hydrocarbons (oil and gas) from subsurface formation zones where such hydrocarbons are trapped. To drill a deviated wellbore, a drilling assembly (also referred to as a bottom-hole assembly or "BHA") that includes a steering device coupled to the drill bit is used. The steering device tilts a lower portion of the drilling assembly by a selected amount and along a selected direction to form the deviated portions of the wellbore. Various types of steering devices have been proposed and used for drilling deviated wellbores. The drilling assembly also includes a variety of sensors and tools that provide a variety of information relating to the earth formation and drilling parameters.

In one such steering device, an actuator mechanism is used in which a rotary valve diverts the mud flow towards a piston actuator, while the entire tool body, together with the valve, is rotating inside the wellbore. In such a mechanism, the valve actuation is controlled with respect to the momentary angular position inside the wellbore (up, down, left, right). A control unit maintains a rotary stationary position (also referred to as geostationary) with respect to the wellbore. As an example, if, during drilling, the drill string and thus the drilling assembly rotates at 60 rpm clockwise, the control unit rotates at 60 rpm counterclockwise, driven by, for example, an electric motor. To maintain a rotary stationary position, the control unit may contain navigational devices, such as accelerometer and a magnetometer. In such systems, the actuation force relies on the pressure drop between the pressure inside the tool and the annular pressure outside the tool. This pressure drop is highly dependent on operating parameters and varies over a wide range. The actuation stroke is a reaction based upon the pressure force exerted onto the actuation pistons. Neither force nor stroke is precisely controllable.

The disclosure herein provides a drilling system that utilizes a steering device that utilizes actuators that rotate along with the drilling assembly to drill deviated wellbores.

SUMMARY

In one aspect, a drilling assembly for use in drilling of a wellbore is disclosed that in one non-limiting embodiment includes a steering device that includes a tilt device and an actuation device, wherein a first section and a second section of the drilling assembly are coupled through the tilt device, and wherein the actuation device tilts the tilt device to cause the first section to tilt relative to the second section along a selected direction while the steering device is rotating.

In another aspect, a method of forming a wellbore is disclosed that in one embodiment includes: conveying a drilling assembly in the wellbore, wherein the drilling assembly includes a disintegration device at an end thereof, a steering device that includes a tilt device and an actuation device, wherein a first section and a second section of the drilling assembly are coupled through the tilt device, and wherein the actuation device tilts the tilt device to cause the first section to tilt relative to the second section about the tilt device along a selected direction while the steering unit is rotating; drilling the wellbore using the disintegration device; and actuating the actuation device to tilt the tilt device to cause the first section to tilt relative to the upper section and to maintain the tilt substantially geostationary while the steering device is rotating to form a deviated section of the wellbore.

Examples of the certain features of an apparatus and methods have been summarized rather broadly in order that the detailed description thereof that follows may be better understood, and in order that the contributions to the art may be appreciated. There are, of course, additional features that will be described hereinafter and which will form the subject of the claims.

DRAWINGS

For a detailed understanding of the apparatus and methods disclosed herein, reference should be made to the accompanying drawings and the detailed description thereof, wherein like elements are generally given same numerals and wherein.

DETAILED DESCRIPTION

Figure 1:
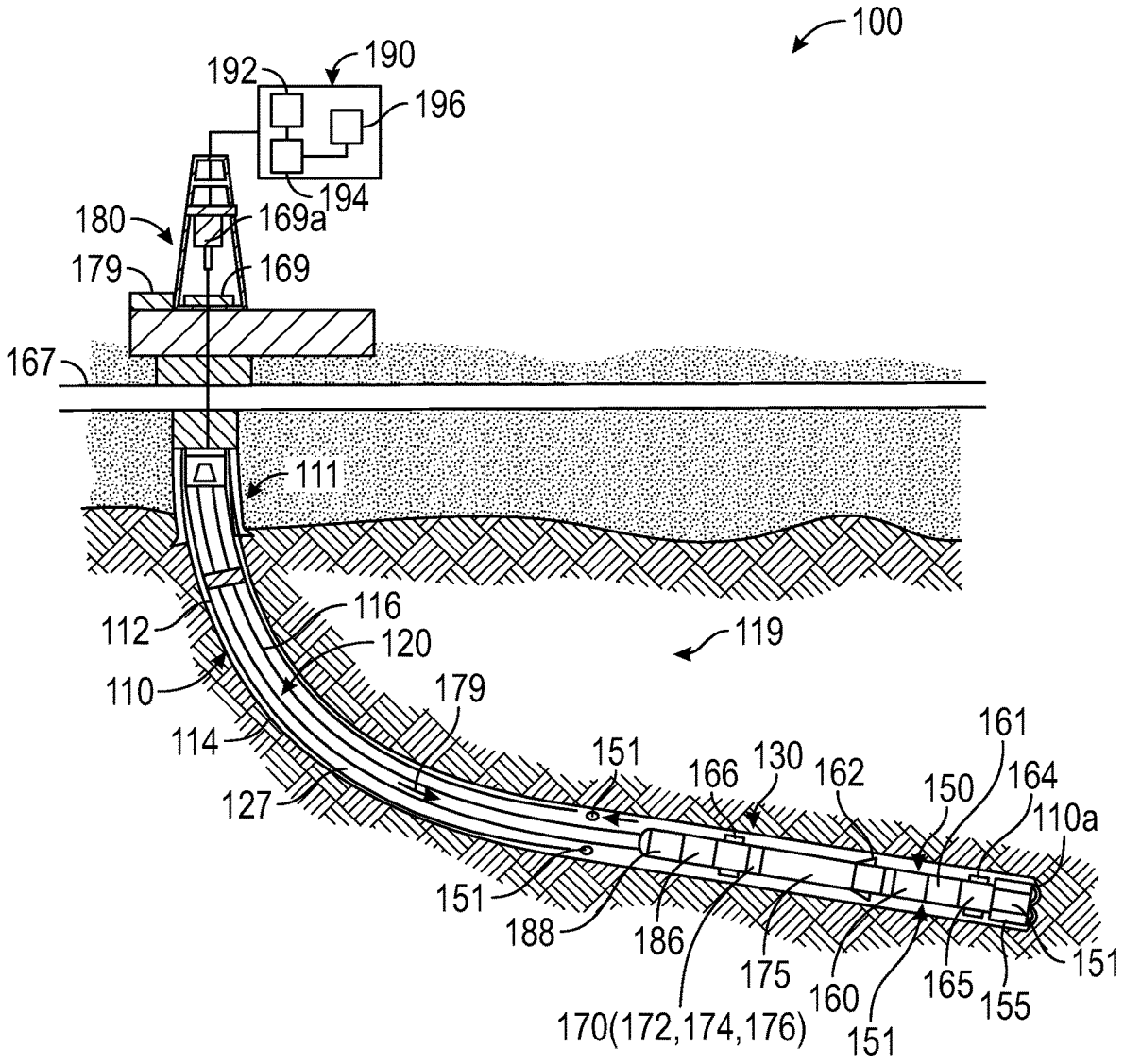
FIG. 1 shows a schematic diagram of an exemplary drilling system that may utilize a steering unit for drilling deviated wellbores, according to one non-limiting embodiment of the disclosure.

FIG. 1 is a schematic diagram of an exemplary rotary steerable drilling system 100 that utilizes a steering device (also referred to as steering unit or steering assembly) in a drilling assembly for drilling vertical and deviated wellbores and maintain the steering device geostationary or substantially geostationary while the steering device is rotating. A deviated wellbore is any wellbore that is non-vertical. The drilling system 100 is shown to include a wellbore 110 (also referred to as a "borehole" or "well") being formed in a formation 119 that includes an upper wellbore section 111 with a casing 112 installed therein and a lower wellbore section 114 being drilled with a drill string 120. The drill string 120 includes a tubular member 116 that carries a drilling assembly 130 (also referred to as the "bottomhole assembly" or "BHA") at its bottom end. The drilling tubular 116 may be a drill pipe made up by joining pipe sections. The drilling assembly 130 is coupled to a disintegrating device 155, such as a drill bit) or another suitable cutting device, attached to its bottom end. The drilling assembly 130 also includes a number of devices, tools and sensors, as described below. The drilling assembly 130 further includes a steering device 150 to steer a section of the drilling assembly 130 along any desired direction, a methodology often referred to as geosteering. The steering device 150, in one non-limiting embodiment, includes a tilt device 161 and an actuation device oe unit or assembly 160 (for example, an electro-mechanical device or a hydraulic device) that tilts one section, such as the lower section 165 of the drilling assembly 130, relative to another section, such as the upper section 166 of the drilling assembly 130. The section 165 is coupled to the drill bit 155. In general, the actuation device tilts the tilt device 161, which in turn causes the lower section 165 and thus the drill bit 155 to tilt or point a selected extent along a desired or selected direction, as described in more detail in reference to FIGS. 2-6.

Still referring to FIG. 1, the drill string 120 is shown conveyed into the wellbore 110 from an exemplary rig 180 at the surface 167. The exemplary rig 180 in FIG. 1 is shown as a land rig for ease of explanation. The apparatus and methods disclosed herein may also be utilized with offshore rigs. A rotary table 169 or a top drive 169*a* coupled to the drill pipe 116 may be utilized to rotate the drill string 120 and the drilling assembly 130. A control unit (also referred to as a "controller" or "surface controller") 190, which may be a computer-based system, at the surface 167 may be utilized for receiving and processing data transmitted by various sensors and tools (described later) in the drilling assembly 130 and for controlling selected operations of the various devices and sensors in the drilling assembly 130, including the steering device 150. The surface controller 190 may include a processor 192, a data storage device (or a computer-readable medium) 194 for storing data and computer programs 196 accessible to the processor 192 for determining various parameters of interest during drilling of the wellbore 110 and for controlling selected operations of the various tools in the drilling assembly 130 and those of drilling of the wellbore 110. The data storage device 194 may be any suitable device, including, but not limited to, a read-only memory (ROM), a random-access memory (RAM), a flash memory, a magnetic tape, a hard disc and an optical disk. To drill wellbore 110, a drilling fluid 179 is pumped under pressure into the tubular member 116, which fluid passes through the drilling assembly 130 and discharges at the bottom 110*a* of the drill bit 155. The drill bit 155 disintegrates the formation rock into cuttings 151. The drilling fluid 179 returns to the surface 167 along with the cuttings 151 via annular space 127 (also referred as the "annulus") between the drill string 120 and the wellbore 110.

Still referring to FIG. 1, the drilling assembly 130 may further include one or more downhole sensors (also referred to as the measurement-while-drilling (MWD) sensors and logging-while-drilling (LWD) sensors or tools, collectively referred to as downhole devices and designated by numeral 175, and at least one control unit or controller 170 for processing data received from the sensors 175. The downhole devices 175 may include sensors for providing measurements relating to various drilling parameters, including, but not limited to, vibration, whirl, stick-slip, flow rate, pressure, temperature, and weight-on-bit. The drilling assembly 130 further may include tools, including, but not limited to, a resistivity tool, an acoustic tool, a gamma ray tool, a nuclear tool and a nuclear magnetic resonance tool. Such devices are known in the art and are thus not described herein in detail. The drilling assembly 130 also includes a power generation device 186 and a suitable telemetry unit 188, which may utilize any suitable telemetry technique, including, but not limited to, mud pulse telemetry, electromagnetic telemetry, acoustic telemetry and wired pipe. Such telemetry techniques are known in the art and are thus not described herein in detail. Drilling assembly 130, as mentioned above, includes the steering device 150 that enables an operator to steer the drill bit 155 in desired directions to drill deviated wellbores when the drilling assembly is rotating and to maintain the steering device geostationary or substantially geostationary. Stabilizers, such as stabilizers 162 and 164 are provided along the lower section 165 and the upper section 166 to stabilize the steering section 150 and the drill bit 155. Additional stabilizers may be used to stabilize the drilling assembly 130. The controller 170 may include a processor 172, such as a microprocessor, a data storage device 174, such as a solid state memory, and a program 176 accessible to the processor 172. The controller 170 communicates with the controller 190 to control various functions and operations of the tools and devices in the drilling assembly. During drilling, the steering unit 150 controls the tilt and direction of the drill bit 155, as described in more detail in reference to FIGS. 2-6.

Figure 2:
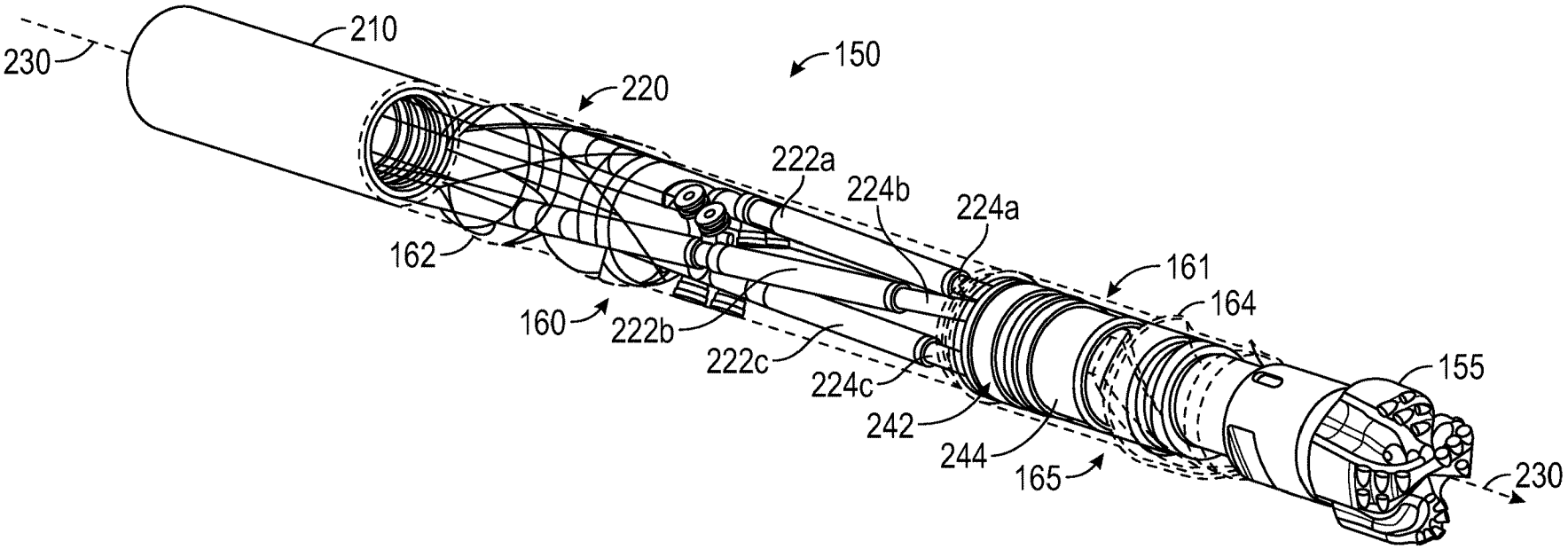
FIG. 2 shows an isometric view of certain elements of an electro-mechanical steering device coupled to a drill bit for drilling deviated wellbores, according to a non-limiting embodiment of the disclosure.

FIG. 2 shows an isometric view of certain elements or components of the steering device 150 for use in a drilling assembly, such as drilling assembly 130 of FIG. 1, to steer or tilt the drill bit 155 for drilling deviated wellbores, according to one non-limiting embodiment of the disclosure. The drilling assembly 130 includes a housing or collar 210 for housing the various elements or components of the steering device 150. The steering device 150 includes a tilt device 161 and an actuation device 160 for tilting the lower section 165 with respect the upper section 166. In one non-limiting embodiment, the tilt device 161 includes an adjuster 242 and a joint 244. The upper section 166 and the lower section 165 are coupled by the joint 244. The adjuster 242 is coupled to the joint 244 in a manner such that when the adjuster 242 is moved a certain amount along a certain direction, it causes the joint 244 to tilt accordingly. The tilt device 161 can be tilted by the actuation device 160 along any direction and by any desired amount to cause the lower section 165 and thus the drill bit 155 to point in any desired direction about a selected point or location in the drilling assembly 130. The adjuster 242 may be a swivel or another suitable device. The joint 244 may be one of a cardan joint, homokinetic joint, constant velocity joint, universal joint, knuckle joint, Hooke's joint, u-joint or another suitable device. The joint 244 transfers axial and torsional loads between the upper section 166 and the lower section 165, while maintaining angular flexibility between the two sections. Stabilizers 162 and 164 are disposed at suitable locations around the steering assembly 150, such as one around the lower section 165 and the other around the upper section 166, to provide stability to the steering unit 150 and the drill bit 155 during drilling operations. In one non-limiting embodiment, the actuation device 160 further includes a suitable number, such as three or more, of electro-mechanical actuators, such as actuators 222*a*, 222*b* and 222*c*, radially arranged spaced apart in the actuation device 160. Each such actuator is connected to a corresponding end 224*a*-224*c* of the adjuster 242. In one embodiment, each actuator is a longitudinal device having a lower end that can be extended and retracted to apply a desired force on the adjuster substantially parallel to the axis 230 to cause the adjuster 160 to move about a longitudinal axis 230 of the steering unit 150. In FIG. 2, of actuators 222*a*-222*c* are shown directly connected respectively to the ends or abutting elements 224*a*-224*c* of the adjuster 242. As described in reference to FIG. 1, the steering unit 150 is part of the drilling assembly 130. During drilling, as the drilling assembly 130 rotates, the steering unit 150 and thus each actuator rotates therewith. Each actuator 222*a*-222*c* is configured to apply force on the adjuster 242, as described later, and depending upon the forces applied, the movement of the adjuster 242 causes the lower section 165 and thus the drill bit 155 to tilt along a desired direction. In the embodiment shown in FIG. 2, since the actuators 222*a*-222*c* are mechanically connected to their corresponding adjuster ends 224*a*-224*c*, the forces applied by such actuators and their respective strokes may be synchronized to create any desired steering direction. Although, the actuators 222*a*-222*c* shown apply axial forces on the adjuster 242, any other suitable device, including, but not limited to a rotary oscillating device, may be utilized to apply forces on the adjuster 242. In aspects, movement of at least a part the electro-mechanical actuation unit 220 may be selectively adjusted or limited (mechanically, such as by providing a stop in the steering device or electronically by a controller) to cause the lower section 165 to tilt with a selected tilt relative to the upper section 166. Also, the tilt of the joint 244 may be selectively adjusted or limited to cause the lower section 165 to tilt with a selected tilt relative to the upper section 166.

Figure 3:
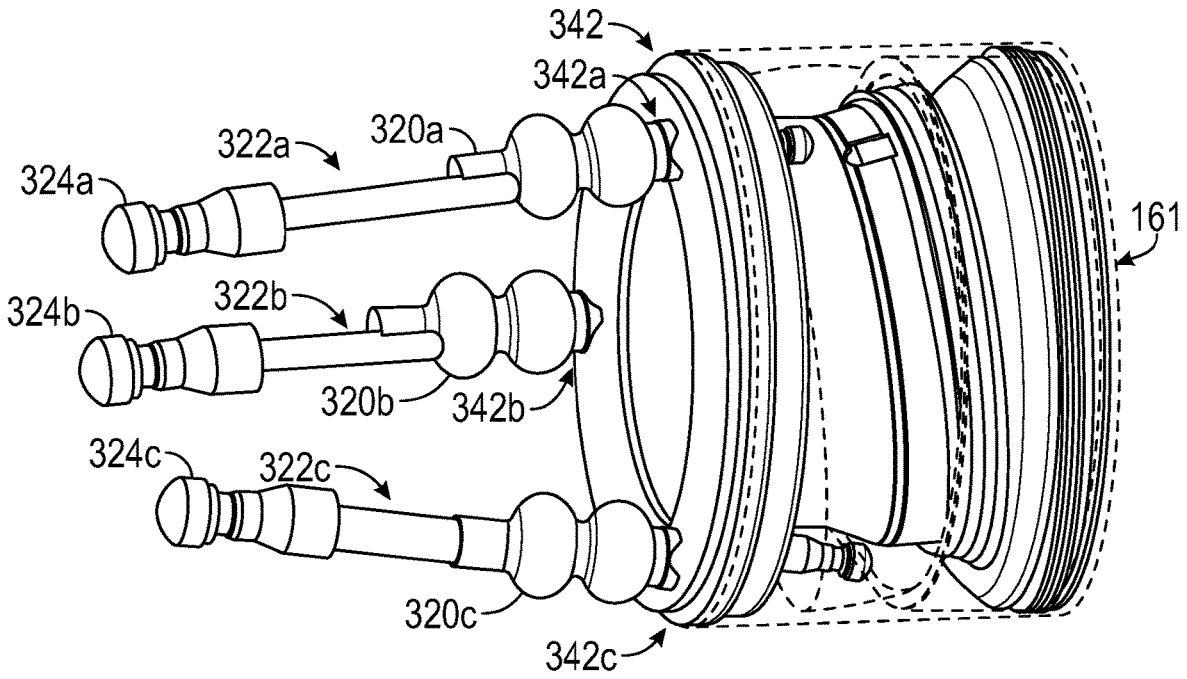
FIG. 3 shows an isometric view of a non-limiting embodiment of an adjuster for use in the steering unit of FIG. 2.

FIG. 3 shows an isometric view of non-limiting embodiment of an adjuster 242 for use in the steering unit 150 of FIG. 2. Referring to FIGS. 2 and 3, the adjuster 242 includes a cylindrical body 342 and a number of spaced apart abutting elements or members, such as connectors 322*a*, 322*b* and 322*c*, with connector 322*a* having one end 320*a* connected to the adjuster end 342*a* and the other end 324*a* for a direct connection to the actuator 222*a*, connector 322*b* having one end 320*b* connected to the adjuster end 342*b* and the other 324*b* for direct connection to the actuator 222*b* and connector 322*c* having one end 320*c* connected to an end of 342*c* of the adjuster 242 and the other end 324*c* for direct connection to the actuator 222*c*. The abutting elements may include elements such as a cam, a crank shaft; an eccentric member; a valve; a ramp element; and a lever. In this configuration, when forces are applied onto the adjuster 242 by the actuators, the adjuster 242 may create an eccentric offset in real time in any desired direction by any desired amount about the tool axis 230, which provides 360 degrees of drill bit maneuvering ability during drilling. The forces on the abutting elements 322*a*-322*c* create a substantially geostationary tilt of the tilt 161 device. In an alternative embodiment, the adjuster 242 may be a hydraulic device that causes the joint 244 to tilt the lower section 165 relative to the upper section 166, as described in more detail in reference to FIG. 6.

Figure 4:
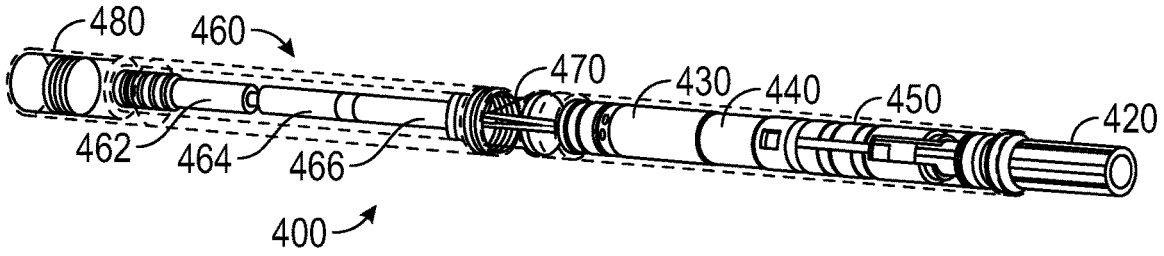
FIG. 4 shows certain elements of a modular electro-mechanical actuator for use in the steering unit of FIG. 2, according to a non-limiting embodiment of the disclosure.

FIG. 4 shows certain elements or components of an individual actuator 400 for use as any of the actuators 222*a*-222*c* in the steering unit 150 of FIG. 2. In one aspect, the actuator 400 is a unitary device that includes a movable end 420 that may be extended and retracted. The actuator 400 further includes an electric motor 430 that may be rotated in clockwise and anticlockwise directions. The motor 430 drives a gear box 440 (clockwise or anti-clockwise) that in turn rotates a drive screw 450 and thus the end 420 axially in either direction. The actuator 400 further includes a control circuit 460 that controls the operation of the motor 430. The controller 460 includes electrical circuits 462 and may include a microprocessor 464 and memory device 466 that houses instructions or programs for controlling the operation of the motor 430. The control circuit 460 is coupled to the motor 430 via conductors through a bus connector 470. In aspects, the actuator 400 may also include a compression piston device or another suitable device 480 for providing pressure compensation to the actuator 400. Each such actuator may be a unitary device that is inserted into a protective housing disposed in the actuator unit 150 (FIG. 1), as described in reference to FIG. 5. During drilling, each such actuator is controlled by its control circuit, which circuit may communicate with the controller 270 (FIG. 1) and/or controller 190 (FIG. 1) to exert force on the adjuster 242 (FIG. 2).

Figure 5:
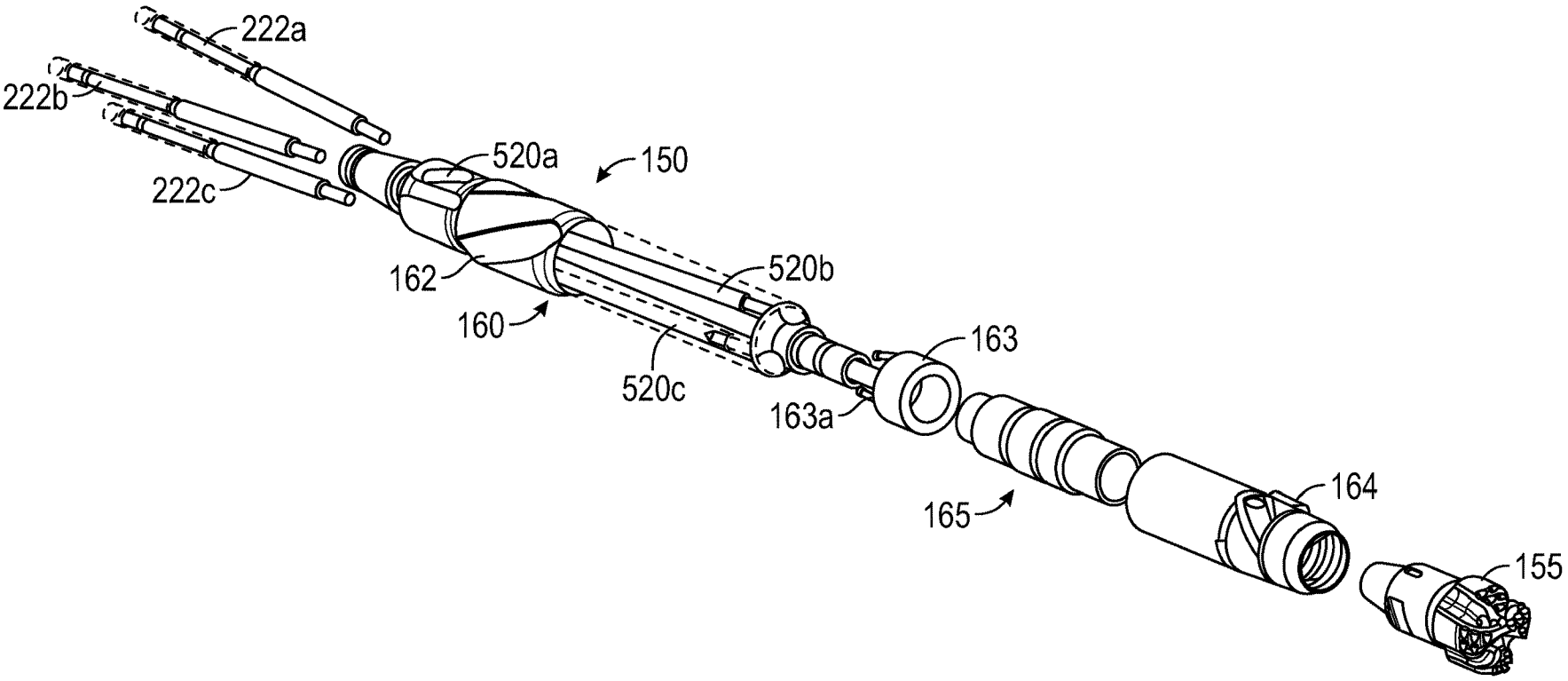
FIG. 5 shows an isometric view of components of the steering unit laid out for assembling the steering unit of FIG. 2.

FIG. 5 shows an isometric view 500 of components of the steering unit 150 of FIG. 2 laid out for assembling the steering unit 150. As described earlier, the actuator unit 150 includes an upper section 166, a lower section 165, an adjuster 242 and a joint 244 between the upper section 166 and the lower section 165. The upper section 166 includes bores or pockets 520*a*, 520*b* and 520*c*, corresponding to each of the individual actuators, such as actuators 222*a*-222*c*. The actuator 222*a* is inserted into the bore or pocket 520*a*, actuator 222*b* into bore or pocket 520*b* and actuator 222*c* into bore or pocket 520*c*. The actuators 222*a*-222*c* are connected to the upper ends 224*a*-224*c* of the adjuster 242 as described above in reference to FIGS. 2 and 3. The adjuster 242 is connected to the lower section 165 by means of the joint 244 to complete the actuator unit assembly. The steering unit 150 is connected to the drill bit 155.

Figure 6:
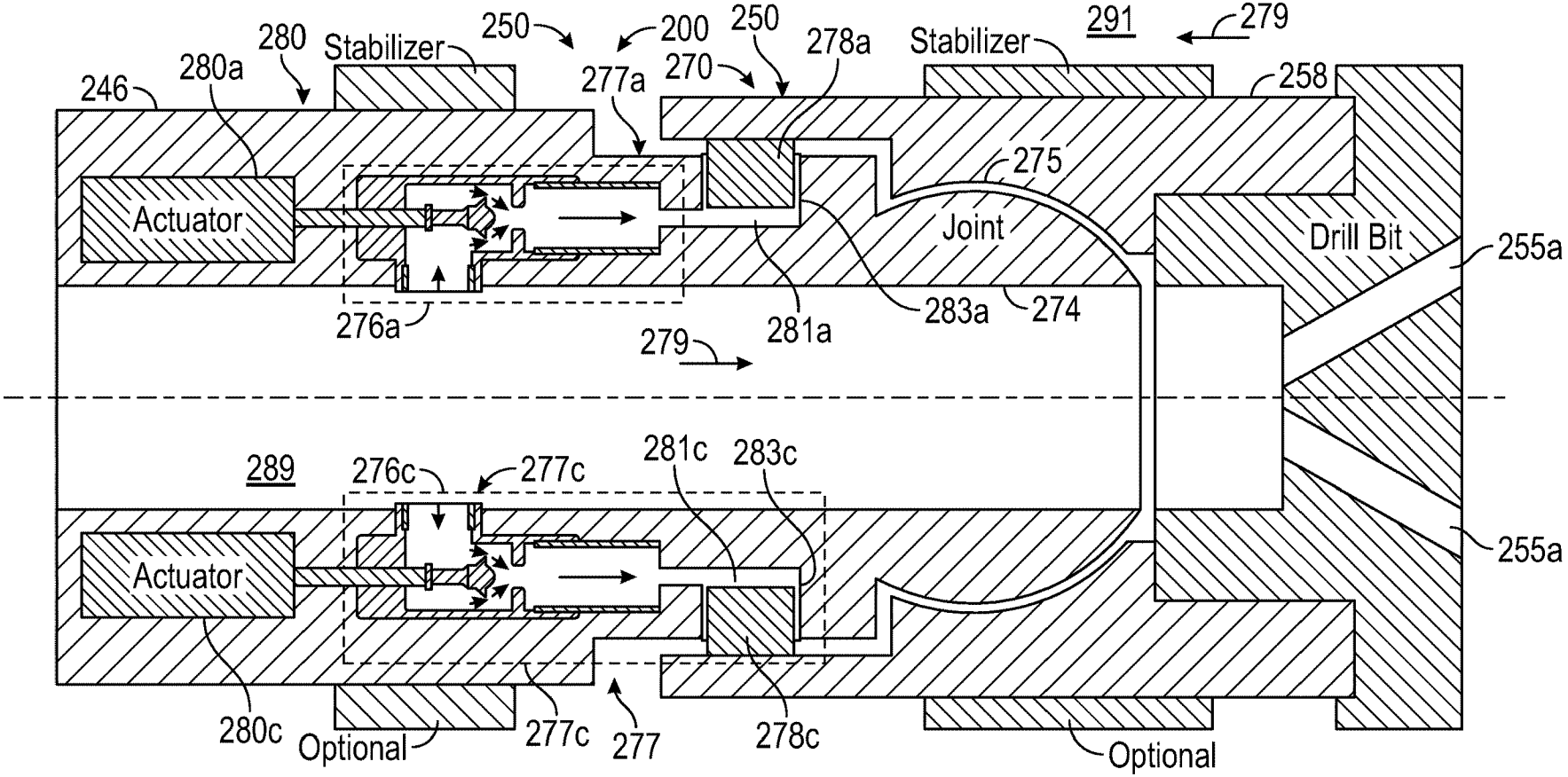
FIG. 6 is a block diagram of a drilling assembly that utilizes a steering device having an actuation de vice and a hydraulic force application device, according to a non-limiting embodiment of the disclosure.

FIG. 6 is a block diagram of a drilling assembly 200 that utilizes a steering device 250 that includes an actuation device 280 and a tilt device 270. The actuation device 280 shown is the same as shown in FIG. 2 and includes three or more actuators 280*a*-280*c* disposed in a housing 210. The tilt device 270 includes an adjuster 277 and a joint 274. In one non-limiting embodiment, the adjuster 277 includes a separate hydraulic force application device corresponding to each of the actuators 280*a*-280*c*. In FIG. 2, force applications devices 277*a*-277*c* respectively correspond to and are connected to actuators 282*a*-282*c*. The actuators 280*a*-280*c* selectively operate their corresponding force application devices 277*a*-277*c* to tilt the lower section 258 relative to the upper section 246 about the joint 274 when the drilling assembly 200 and thus the steering device 250 is rotating. In one non-limiting embodiment, each of the force application devices 277*a*-277*c* includes a valve in fluid communication with pressurized fluid 279 flowing through channel 289 in the drilling assembly 200 and a chamber that houses a piston. In the embodiment of FIG. 2B, force application devices 277*a*-277*c* respectively include valves 276*a*-276*c* and pistons 278*a*-278*c* respectively disposed in chambers 281*a*-281*c*. During drilling, the steering device 250 rotates while the pressurized drilling fluid 279 flows through channel 289 and exits through the passages or nozzles 255*a* in the drill bit 255. The exiting fluid 279*a* returns to the surface via annulus 291, which creates a pressure drop between the channel 289 and the annulus 291. In aspects, the disclosure herein utilizes such a pressure drop to activate the hydraulic force application devices 277*a*-277*c* to create a desired tilt of the lower section 246 relative to the upper section 246 about the joint 274 and to maintain such tilt geostationary or substantially geostationary while the steering assembly 250 is rotating. To tilt the drill bit 255 via the sections 258 and 246, the actuators 280*a*-280*c* selectively open and close their corresponding valves 276*a*-276*c*, allowing the pressurized fluid 279 from channel 289 to flow to the cylinders 281*a*-281*c* to extend pistons 278*a*-278*c* radially outward, which apply desired forces on the adjuster 277 to tilt the lower section 258 and thus the drill bit 255 along a desired direction. Each piston and cylinder combination may include a gap, such as gap 283*a* between piston 278*a* and cylinder 281*a* and gap 283*c* between piston 278*c* and chamber 281*c*. Such a gap allows the fluid entering a chamber to escape from that chamber into the annulus 291 when the valve is open and the piston is forced back into its cylinder. Alternatively, one or more nozzles or bleed holes (not shown) connected between the cylinder and the annulus 291 may be provided to allow the fluid to flow from the chamber into the annulus 291. To actively control the tilt of the lower section 258 while the rotary steerable drilling assembly 200 is rotating, the three or more valves 276*a*-276*c* may be activated sequentially and preferably with the same frequency as the rotary speed (frequency) of the drilling assembly 200, to create a geostationary tilt between the upper section 246 and the lower section 258. For instance, referring to FIG. 6, if an upward drilling direction is desired, the actuator 280*c* is momentarily opened, forcing the piston 278*c* to extend outward. At the same moment, actuator 280*a* would close valve 276*a*, blocking pressure from the channel 289 to the piston 278*a*. Since all pistons 276*a*-276*c* are mechanically coupled through the joint 274, piston 278*a* would return or retract upon the outboard stroke of piston 278*c*. When the drilling assembly 200 rotates, e. g. by 180° and for the case of four actuators distributed equi-spaced around the circumference of the drilling assembly 200, the activation would reverse, actuator 280*a* opening valve 276*a* and actuator 280*c* closing valve 276*c*, thus maintaining a geostationary tilt direction. Similar methods may be utilized to tilt and maintain the tilt geostationary for the embodiment shown in FIG. 2.

Referring to FIGS. 1-6, the steering unit 150 described herein is in the lower portion of a drilling assembly 130 (FIG. 1) of a rotary drilling system 100. The steering unit 150 includes an adjuster and a joint connected to an actuation device that maneuvers or tilts the adjuster about a drilling assembly axis, which in turn tilts the joint. The joint tilts a lower section containing the drill bit relative to an upper section of the drilling assembly. The system transmit torque from a collar to the drill bit. In one non-limiting embodiment, the adjuster is actively tilted by a selected number of intermittently activated electro-mechanical actuators. The actuators rotate with the drilling assembly and are controlled by signal inputs from one or more position sensors in the drilling assembly 130. Any suitable directional sensors, including, but not limited to magnetometers, accelerometer and gyroscopes may be utilized. Such sensors provide real time position information relating to the wellbore orientation while drilling. Depending on the type and the design of the adjuster the actuators may perform reciprocating or rotary oscillating movement, e. g., actuators coupled to a cam or crank system further enabling the eccentric offset in any desired direction from the drilling assembly axis during each revolution of the drilling assembly, creating a geostationary force and offset of the adjuster axis.

The system 100 disclosed herein does not require a control unit to counter-rotate the tool body rotation. The modular activators positioned in the outer diameter of the actuation assembly receive command signals from a controller located in another section of the tool or higher up in the drilling assembly that may also include navigational sensors. These navigational sensors rotate with the drilling assembly. Such a mechanism can resolve and process the rotary motion of the drilling assembly to calculate momentary angular position (while rotating) and generate commands to the individual actuators substantially instantaneously. As an example, assume the drilling assembly rotates at ⅓ revolutions per second (20 rpm). The current steering vector is intended to point upwards. Assuming the side force element increases eccentricity with positive displacement of the actuation units, the navigational package electronics determine the momentary angular position of the drilling assembly or the steering unit with respect to the earthen formation and sends commands to all of the actuators (stroke and force). At time zero second, one of the actuators (for example the lowermost) receives a command to stroke outward a certain distance. At time 1 second, the steering unit has rotated 120 degrees and the same actuator receives the command to decrease the stroke to approximately to the middle position. At time 1.5 seconds, this actuator is at the uppermost position and the navigational package electronics sends a command to further decrease the stroke of a similar value as sent at zero second, but negative from a middle position. The commands are constantly sent to each actuator with their respective stroke requirements. With the changes for the stroke of the actuators, the angular tilt can be controlled and adjusted in real time. In such a configuration, each actuator performs one stroke per tool revolution (positive and negative from the middle position). To drill a straight wellbore section, all actuators are maintained stationary at their respective middle positions, thus requiring only minimum energy supply to hold the centralized position. The amount of the tilt angle and the momentary direction of the tilt angle controls the drilling direction of the wellbore.

The foregoing disclosure is directed to the certain exemplary non-limiting embodiments. Various modifications will be apparent to those skilled in the art. It is intended that all such modifications within the scope of the appended claims be embraced by the foregoing disclosure. The words "comprising" and "comprises" as used in the claims are to be interpreted to mean "including but not limited to". Also, the abstract is not to be used to limit the scope of the claims.

The invention claimed is:

1. A drilling assembly for use in drilling of a wellbore, comprising:

a steering unit having a tilt device and an actuation device, wherein a first section and a second section of the drilling assembly are coupled through the tilt device and wherein the first section is attached to a drill bit, and wherein the actuation device causes a tilt of the tilt device to cause the first section attached to the drill bit and the drill bit to tilt relative to the second section along a selected first direction while the steering unit is rotating.

2. The drilling assembly of claim 1, wherein the actuation device applies forces on the tilt device in a manner that maintains the tilt of the tilt device geostationary or substantially geostationary when the steering unit is rotating.

3. The drilling assembly of claim 1, wherein the tilt device includes an adjuster and wherein the actuation device applies forces onto the adjuster to cause the adjuster to move along a selected second direction.

4. The drilling assembly of claim 3, wherein the tilt device further includes a joint coupled to the actuation device, wherein applying the forces on the adjuster by the actuation device causes the first section attached to the drill bit and the drill bit to tilt about the joint relative to the second section.

5. The drilling assembly of claim 1, wherein movement of at least a part of the actuation device is selectively adjustable to cause the first section attached to the drill bit and the drill bit to tilt with a selected tilt relative to the second section.

6. The drilling assembly of claim 4, wherein a tilt of the joint is selectively adjustable to cause the first section attached to the drill bit and the drill bit to tilt with a selected tilt relative to the second section.

7. The drilling assembly of claim 1, wherein the tilt device is a hydraulic device and wherein the actuation device drives the hydraulic device to cause tilting of the first section attached to the drill bit and the drill bit relative to the second section.

8. The drilling assembly of claim 7, wherein the actuation device selectively operates a valve of the hydraulic device to divert fluid flowing through the drilling assembly to cause the tilting of the first section attached to the drill bit and the drill bit relative to the second section.

9. The drilling assembly of claim 1, wherein the actuation device includes a one or more spaced apart actuators, and wherein each actuator of the one or more spaced apart actuators is configured to apply a force on one or more abutting elements of the tilt device.

10. The drilling assembly of claim 9 further including a controller that controls the movement of at least one of the one or more spaced apart actuators.

11. The drilling assembly of claim 9, wherein the one or more abutting elements are selected from a group consisting of: a cam; a crank shaft; an eccentric member; a valve; a ramp element; and a lever.

12. The drilling assembly of claim 9, wherein the force on the one or more abutting elements of the tilt device create a substantially geostationary tilt of the tilt device.

13. The drilling assembly of claim 1 further comprising a controller that controls the tilt of the tilt device in response to a parameter of interest.

14. The drilling assembly of claim 13, wherein the parameter of interest is obtained from a response of a sensor selected from a group consisting of: an accelerator; a gyroscope; a magnetometer, a formation evaluation sensor.

15. The drilling assembly of claim 9, wherein each of the one or more spaced apart actuators applies the force on the one or more abutting elements once during each revolution of the steering unit.

16. A method of drilling a wellbore, comprising:

conveying a drilling assembly in the wellbore, wherein the drilling assembly includes a drill bit at an end thereof, a steering unit that includes a tilt device and an actuation device, wherein a first section and a second section of the drilling assembly are coupled through the tilt device and wherein the first section is attached to the drill bit, and wherein the actuation device tilts the tilt device to cause the first section attached to the drill bit and the drill bit to tilt relative to the second section about the tilt device along a selected direction while the steering unit is rotating;

drilling the wellbore using the drill bit; and actuating the actuation device to tilt the tilt device to cause the first section attached to the drill bit and the drill bit to tilt relative to the second section and to maintain the tilt geostationary while the drilling assembly is rotating to form a deviated section of the wellbore.

17. The method of claim 16, wherein the tilt device includes an adjuster and a joint and wherein the method further comprises applying forces on the adjuster to tilt the joint to cause the first section attached to the drill bit and the drill bit to tilt relative to the second section along the selected direction.

18. The method of claim 16, wherein the actuation device includes a plurality of spaced apart actuators, wherein each actuator of the plurality of spaced apart actuators is configured to apply a force on an abutting element of the tilt device.

19. The method of claim 16 further comprising selectively adjusting movement of at least a part of the actuation device to cause the first section attached to the drill bit and the drill bit to tilt with a selected tilt relative to the second section.

20. The method of claim 16, wherein the actuation device includes a plurality of actuators, the method further comprising causing each actuator of the plurality of actuators to perform one stroke from a middle position thereof per revolution of the drilling assembly to drill the deviated section of the wellbore.

* * * * *